US012324975B1

(12) United States Patent
Zimmerman et al.

(10) Patent No.: US 12,324,975 B1
(45) Date of Patent: Jun. 10, 2025

(54) RACK FOR SPORT BOARDS

(71) Applicants: Lior Zimmerman, Rishpon (IL); Amit Lavion, Beit Yehoshua (IL)

(72) Inventors: Lior Zimmerman, Rishpon (IL); Amit Lavion, Beit Yehoshua (IL)

( * ) Notice: Subject to any disclaimer, the term of this patent is extended or adjusted under 35 U.S.C. 154(b) by 0 days.

(21) Appl. No.: 18/600,719

(22) Filed: Mar. 10, 2024

(51) Int. Cl.

| | |
|---|---|
| ***A63B 71/00*** | (2006.01) |
| ***A47B 46/00*** | (2006.01) |
| ***A47B 81/00*** | (2006.01) |
| ***B63B 32/83*** | (2020.01) |

(52) U.S. Cl.
CPC ..... *A63B 71/0036* (2013.01); *A47B 46/00* (2013.01); *A47B 81/00* (2013.01); *B63B 32/83* (2020.02); *A63B 2210/50* (2013.01)

(58) Field of Classification Search
CPC ..... A63B 71/0036; A63B 2210/06; A63B 2210/50; A63B 2210/58; B65D 69/00; A47B 61/02; A47B 46/00; A47B 81/00; A47F 5/10; B63B 32/80; B63B 32/83; B63B 32/87
USPC ..... 211/85.7, 100, 87.01, 1.3, 2, 193, 70.5; 312/240; 206/315.1, 216, 223, 577, 579
See application file for complete search history.

(56) References Cited

U.S. PATENT DOCUMENTS 1,818,761 A * 8/1931 Sendler ..... D06F 57/12 312/271
3,380,429 A * 4/1968 Moinicken ..... E01F 13/02 116/63 P
3,612,284 A * 10/1971 Stoltz ..... D06F 57/12 211/105
4,274,571 A * 6/1981 Lafreniere ..... A63C 11/025 294/147
4,485,928 A * 12/1984 Staashelm ..... A47B 46/00 312/246
4,513,974 A * 4/1985 Lin ..... A63F 3/0023 273/287
5,285,906 A * 2/1994 Wisnowski ..... A47B 81/00 211/70.5
5,377,976 A * 1/1995 Matherne ..... A63B 63/083 473/483
5,727,857 A * 3/1998 Smith ..... A47F 3/0404 312/351.3
6,158,578 A * 12/2000 Greiner ..... A47F 5/10 211/85.2
6,234,442 B1 * 5/2001 Huang ..... A47B 97/08 211/195
6,296,213 B1 * 10/2001 Law, III ..... G10G 5/00 206/759
6,969,132 B1 * 11/2005 Viville ..... B65D 81/38 211/1.3

(Continued)

*Primary Examiner* — Jennifer E. Novosad

(57) ABSTRACT

A rack that is designed to be connected to a wall for hanging sport boards that includes a casing, a drawer, several right and left arms with connectors that match corresponding connectors in the casing. The drawer can slide inside and outside the casing and to be contained inside the casing. The right and the left arms are designed to be connected to the casing facing outward and to the right and to the left sides. The arms are designed to receive the sport boards. The inner length of the drawer is equal to or greater than the length of the arms, and the inner width of the drawer is equal to or greater than the width of the arms. The drawer is designed to contain the arms when the rack is not in use.

9 Claims, 5 Drawing Sheets

(56) References Cited

U.S. PATENT DOCUMENTS

| | | | | |
|---|---|---|---|---|
| 7,520,840 | B2 * | 4/2009 | Shifferaw | A63B 23/0458 482/52 |
| 7,637,376 | B2 * | 12/2009 | Silva | A63D 15/10 206/45.24 |
| 9,675,831 | B2 * | 6/2017 | Beaver | A63B 1/00 |
| 10,034,544 | B2 * | 7/2018 | Berger | A47B 81/00 |
| 10,092,791 | B2 * | 10/2018 | Donnelly | A63B 21/0726 |
| 10,118,678 | B2 * | 11/2018 | Dias | B63B 32/83 |
| 10,321,758 | B2 * | 6/2019 | Martinage | A47B 43/00 |
| 11,690,448 | B1 * | 7/2023 | Zimmerman | A63C 11/028 211/85.7 |
| 11,802,366 | B2 * | 10/2023 | Bickerton | A47L 23/20 |
| 11,933,569 | B1 * | 3/2024 | Chernik | B25B 1/2405 |
| 2006/0052220 | A1 * | 3/2006 | Jackson | A63B 23/0458 482/52 |
| 2009/0071922 | A1 * | 3/2009 | Barra | F16M 11/046 211/85.3 |
| 2009/0124464 | A1 * | 5/2009 | Kastelic | A63B 23/0458 482/52 |
| 2010/0164339 | A1 * | 7/2010 | Jenkins | A47B 61/02 312/294 |
| 2015/0014212 | A1 * | 1/2015 | Beaver | B65D 25/10 206/579 |
| 2015/0306488 | A1 * | 10/2015 | Gouldthorpe | A47B 81/00 211/85.7 |
| 2015/0330558 | A1 * | 11/2015 | Intravatola | F16M 11/28 362/184 |
| 2016/0166889 | A1 * | 6/2016 | Zwart | A45C 13/005 206/579 |

* cited by examiner

RACK FOR SPORT BOARDS

FIELD OF THE INVENTION

The present invention refers to a rack that is designed to be connected to a wall for hanging sport boards.

BACKGROUND ART

Many people who have several sport boards, for surfing, skateboarding, snowboarding, windsurfing, sandboarding, and other kinds of sport activities that are performed mainly by a board on water, on pavement, on unpaved land, on snow, on sand, or in air for example. The term "sport boards" in the present disclosure and in the claims refer to all those kinds of boards that are used in these sport activities. In such cases, a stand or a rack is needed for placing the boards safely, stable and without using much space. The present invention discloses an innovative rack for sport boards that can be disassembled and assembled without the need of tools or screws, and that enable to store the parts of the rack in a drawer that is contained in the base of the rack. The rack is easily assembled and disassembled easily into a compact, portable package inside the base of the rack that serves as a box of its parts.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

Figure 1:
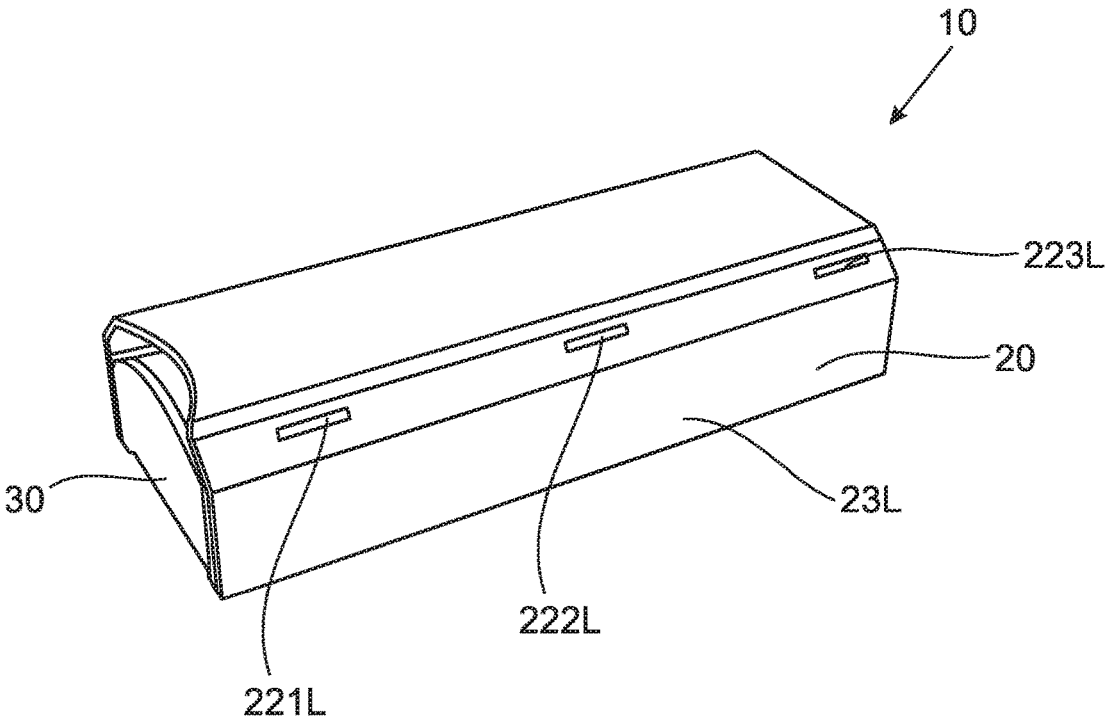
FIG. 1 depicts the rack (10) when all its parts are inside the drawer.

The objective of the present invention is to provide a rack (10) that is designed to be connected to a wall (100) for hanging at least a first sport board (200A). The rack (10) includes a casing (20), a drawer (30), a first right arm (41R) and a first left arm (41L).

The casing (20) may include one or more casing rails (21), and a first casing right connector (221R) preferably in a right side (23R) of the casing and a first casing left connector (221L) preferably in a left side (23L) of the casing.

The drawer (30) may include one or more drawer rails (31) that match the casing rails (21) and the drawer is designed to be contained inside the casing and to slide inside and outside the casing possibly along said rails.

The first right arm (41R) includes a first right arm connector (411R) that matches the first casing right connector and that is designed to firmly attached the first right arm to the casing in a way that the first right arm faces outward and to the right side. The first left arm (41L) too includes a first left arm connector (411L) that matches the first casing left connector that is designed to firmly attached the first left arm to the casing in a way that the first left arm faces outward and to the left side.

The connectors can be of a variety of known connector pairs, such as holes and screws, so that for example the arm connector is a screw and the matching casing connector is a hole into which the screw can be screwed, or that the arm connector is a stopping tab and the casing connector is a matching slot, as described for example in the drawings, so that the stopping tab is designed to be inserted into the casing slot such that the arm is firmly attached to the casing.

The first left and right arms are designed to receive the sport board when the sport board is placed on the first right arm and the first left arm when the first right arm and the first left arm are firmly attached to the casing.

The inner length (32) of the drawer is equal to or greater than the length (44) of the first right arm and of the first left arm, and an inner width (33) of the drawer is equal to or greater than the width (45) of the first right arm and of the first left arm, and therefore the drawer is designed to contain the first arms when the rack is not in use.

It is possible to manufacture the rack and its parts from metal, plastic or preferably from wood. The connection of the parts of the rack to each other is done with bare hands without the need for working tools. The rack can be disassembled and assembled by hand, without the need for special skill. The dimensions of the rack may and should fit standard sizes of sport boards. The casing is substantially in a shape of a rectangular box containing a drawer that is designed to contain the arms when the rack is disassembled for transporting or storing.

When the rack is hanged on the wall, then the casing is fixed to the wall (possible by two or more screws) while the drawer can be slid down to an open position or slid up to be in a closed position where it is all inside the casing. The drawer and the casing include matching stop elements as usual (not visible in the drawings) which are designed to prevent the entire drawer from coming out of the casing. In addition to that, the rack may further include one or more small shelves (50) of a size that can fit in the drawer, so that all the components of the rack can be stored inside the drawer, and these shelves can be placed inside the drawer so that they are horizontal when the rack is hanged on the wall, as depicted in the drawings, for placing objects on them.

The rack may be designed for hanging two sport boards (a second sport board 200B) and in such version the rack may further includes a second right arm (42R) and a second left arm (42L), the casing may further include a second casing right connector (222R) preferably in its right side and a second casing left connector (222L) preferably in its left side. According to the same principles as stated above, the second right arm (42R) includes a second right arm connector (421R) that matches the second casing right connector, and the second left arm (42L) too includes a second left arm connector (421L) that matches the second casing left connector. The second right and left arms are designed to receive a sport board. The inner length of the drawer is equal to or greater than the length (44) of the second right and left arms, and an inner width of the drawer is equal to or greater than the width (45) of the second right and left arms.

Figure 2:
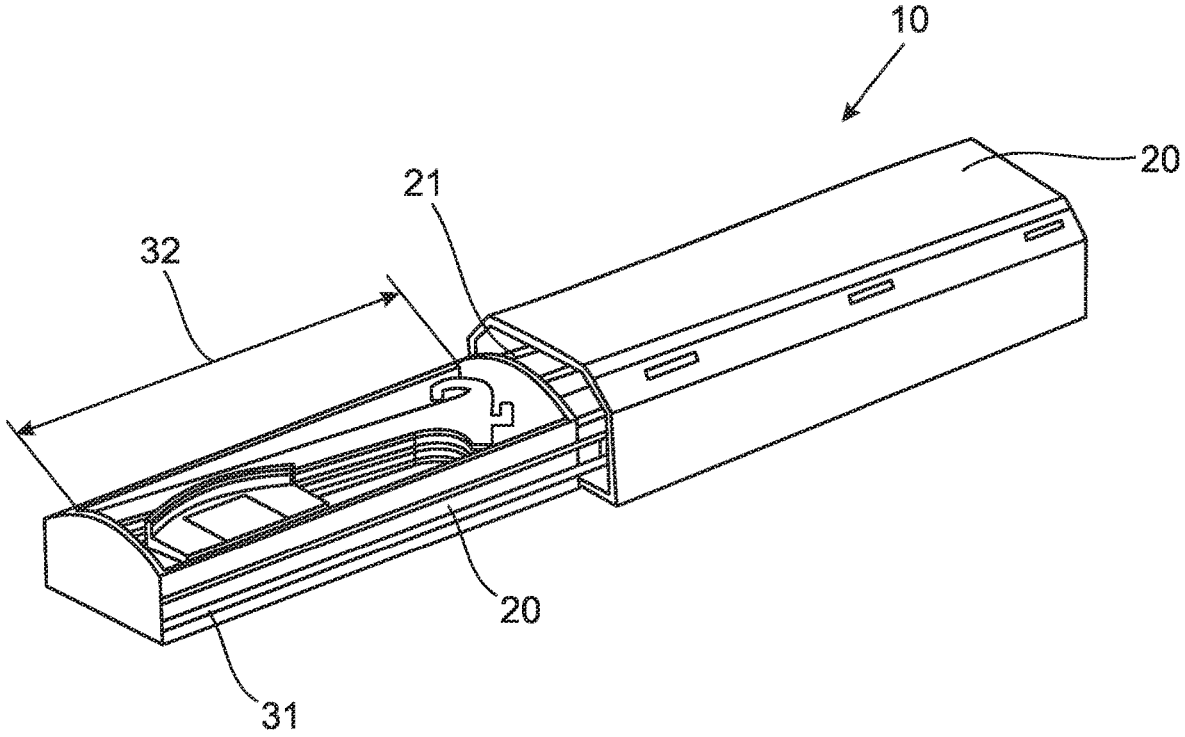
FIG. 2 depicts the rack (10) when the drawer (30) is outside the casing (30) and contain the arms.
Figure 3:
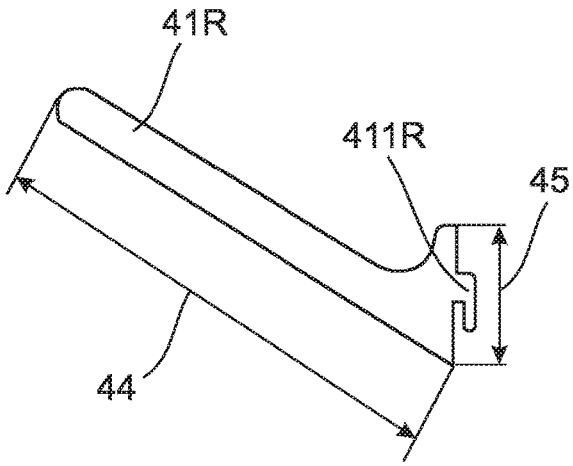
FIG. 3 depicts the first right arm (41R).
Figure 4:
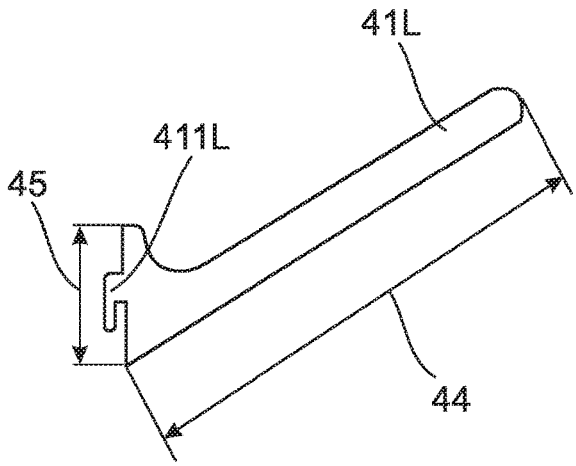
FIG. 4 depicts the first left arm (41L).
Figure 5:
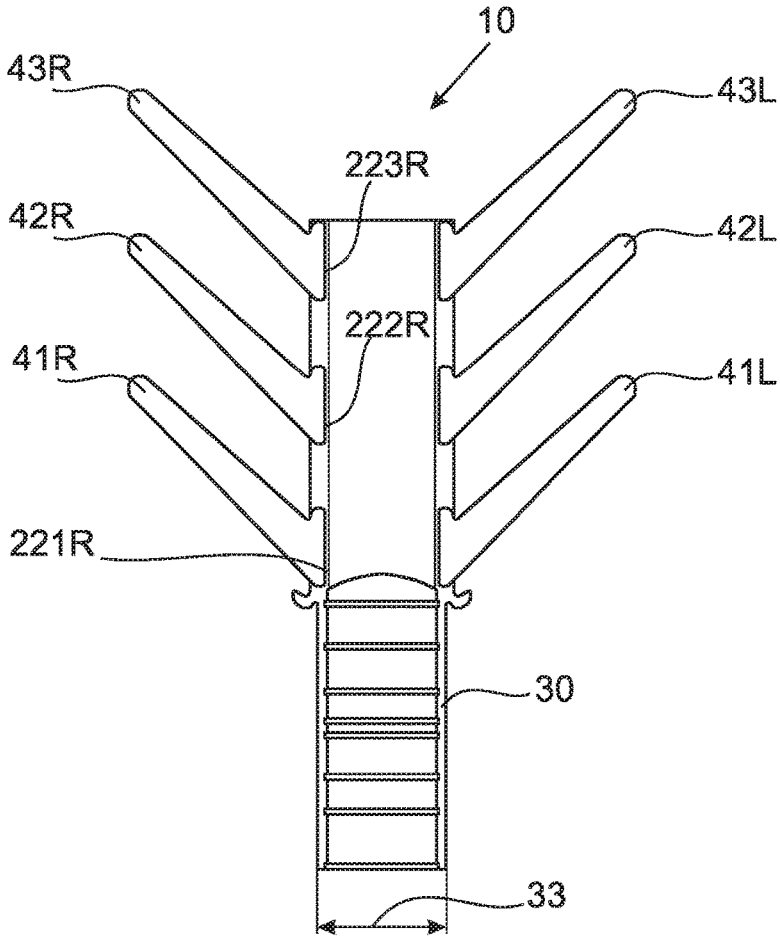
FIG. 5 depicts the rack when the drawer is outside the casing.
Figure 6:
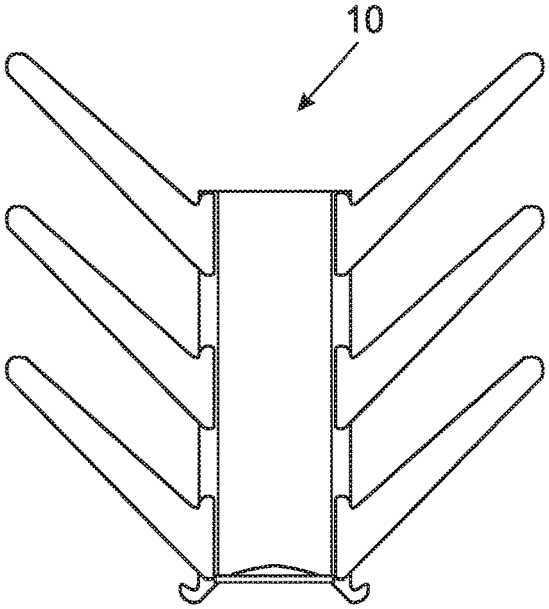
FIG. 6 depicts the rack when hanged on the wall and the drawer is inside the casing.
Figure 7:
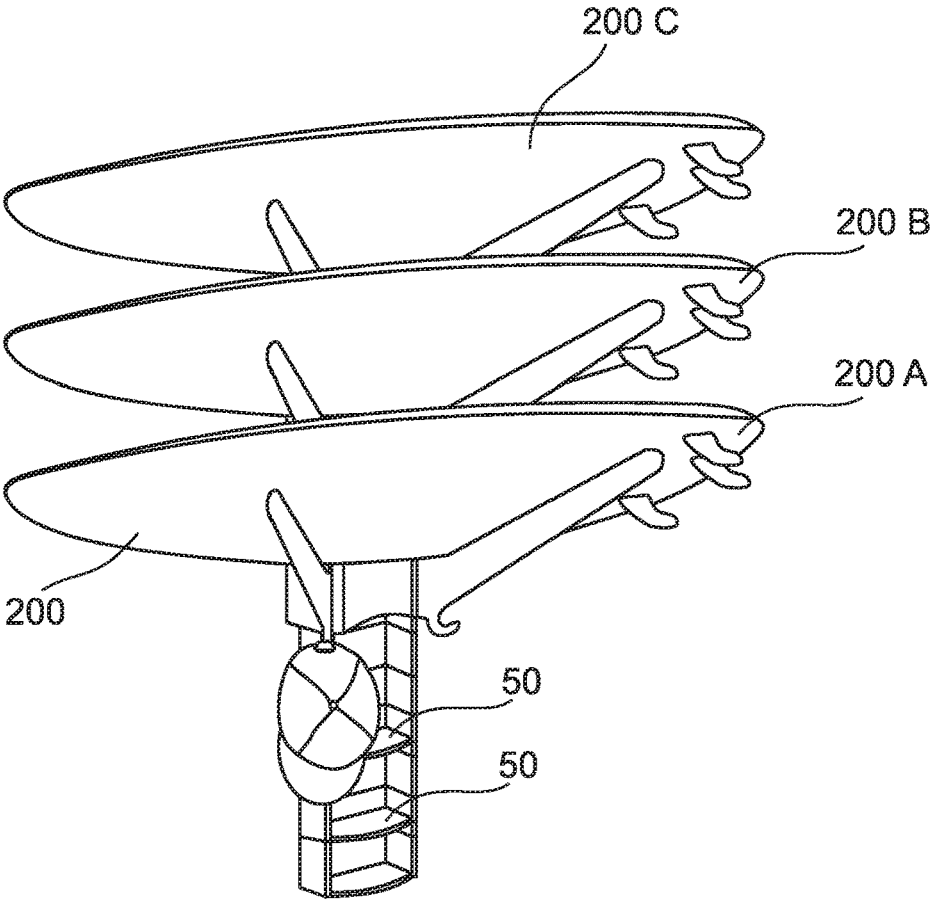
FIGS. 7-9 depict the rack when sports boards are placed on it.
Figure 8:
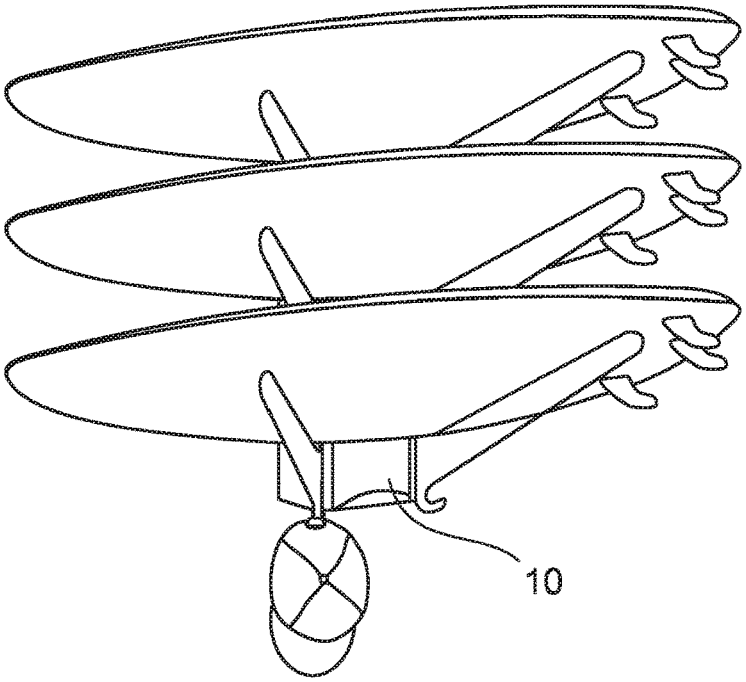
Figure 9:
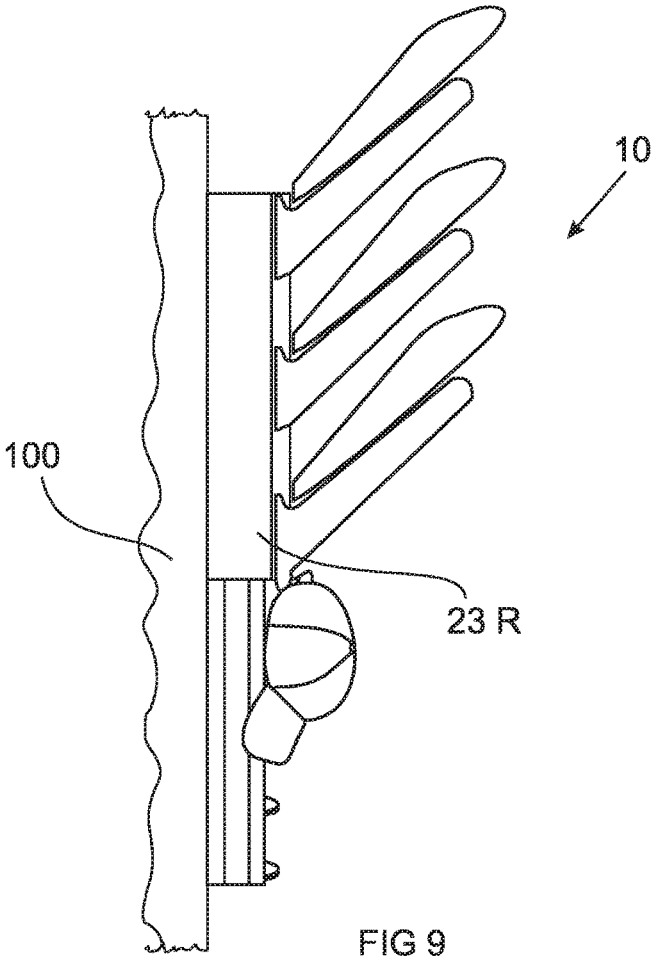
Figure 10:
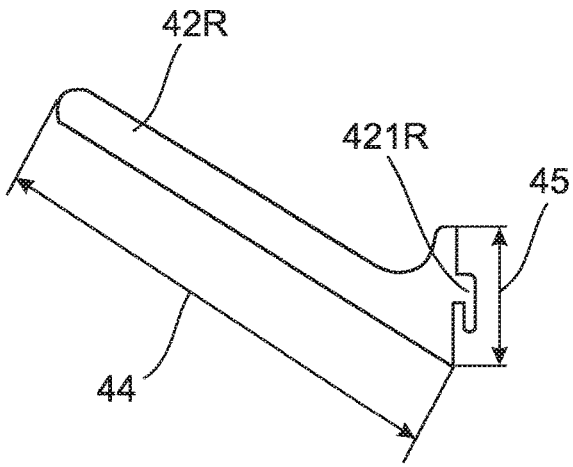
FIG. 10 depicts the second right arm (42R).
Figure 11:
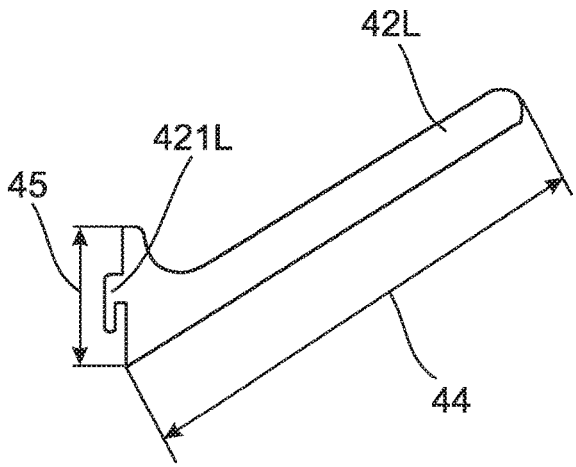
FIG. 11 depicts the second left arm (42L).
Figure 12:
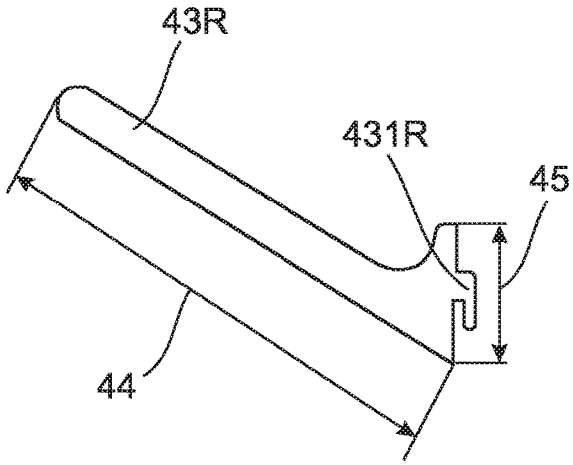
FIG. 12 depicts the third right arm (43R).
Figure 13:
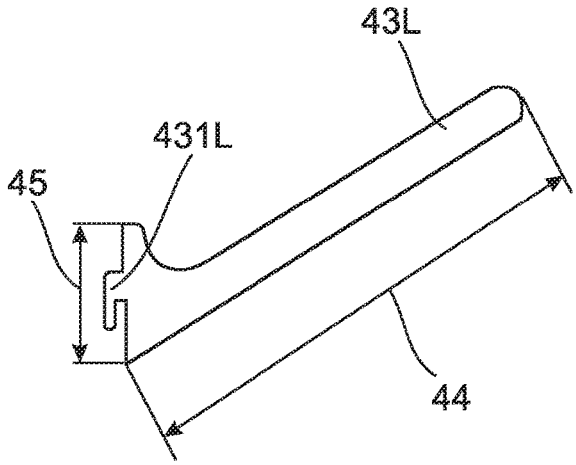
FIG. 13 depicts the third left arm (43L).

The rack may be designed for hanging three sport boards (a third sport board 200C) and in such version the rack may further includes a third right arm (43R) and a third left arm (43L), the casing may further include a third casing right connector (223R) preferably in its right side and a third casing left connector (223L) preferably in its left side. According to the same principles as stated above, the third right arm (43R) includes a third right arm connector (431R) that matches the third casing right connector, and the third left arm (43L) too includes a third left arm connector (431L) that matches the third casing left connector. The third right and left arms are designed to receive a sport board. The inner length of the drawer is equal to or greater than the length (44) of the third right and left arms, and an inner width of the drawer is equal to or greater than the width (45) of the third right and left arms. The casing and the drawer may include one or more stoppers (not shown in the drawings) that are designed to prevent the drawer fall down from the casing when the rack is hanged on the wall, and lockers that are designed to lock the drawer inside the casing when the rack is hanged on the wall FIG. 1 depicts the rack (10) when its parts inside the drawer, FIG. 2 depicts the rack (10) when the drawer (30) is outside the casing (30) and contain the arms, FIG. 3 depicts the first right arm (41R), FIG. 4 depicts the first left arm (41L), FIG. 5 depicts the rack when hanged on the wall (100) when the drawer is outside the casing, FIG. 6 depicts the rack when hanged on the wall and the drawer is inside the casing, FIGS. 7-9 depicts the rack when sports boards are placed on it. FIG. 10 depicts the second right arm (42R), FIG. 11 depicts the second left arm (42L), FIG. 12 depicts the third right arm (43R), and FIG. 13 depicts the third left arm (43L).

We claim:

1. A rack for hanging at least a first sport board whereby the rack comprises a casing, a drawer, at least a first right arm and at least a first left arm;

wherein the rack is designed to be placed in both a first use position whereby the rack is adapted to be connected to a wall and a second stored position;

wherein the casing includes at least a first casing right connector and at least a first casing left connector;

wherein the drawer is designed to slide inside and outside the casing and to be contained inside the casing when in either the first use position or the second stored position;

wherein the first right arm includes a first right arm connector that matches the first casing right connector and that is designed to attach the first right arm to the casing in a way that the first right arm faces outward and to the right side;

wherein the first left arm includes a first left arm connector that matches the first casing left connector and that is designed to attach the first left arm to the casing in a way that the first left arm faces outward and to the left side;

wherein the first right and left arms are designed to receive the first sport board when placed on the first right and left arms that are attached to the casing and the rack is in the first use position;

wherein an inner length of the drawer is equal to or greater than a length of the first right and left arms, and an inner width of the drawer is equal to or greater than a width of the first right and left arms, and wherein the drawer is designed to contain the first right and left arms when the rack is placed in the second stored position.

2. The rack of claim 1 wherein said casing connector is a casing slot and said arm connector is a stopping tab, and wherein the stopping tabs are designed to be inserted into the casing slots such that said arms are attached to the casing.

3. The rack of claim 1 wherein said casing further includes one or more casing rails and wherein said drawer includes one or more drawer rails that match the casing rails so that the drawer is designed to slide inside the casing along said rails.

4. A rack for hanging at least a first sport board and a second sport board whereby the rack comprises a casing, a drawer, a first right arm, a first left arm, a second right arm, and a second left arm, wherein the rack is designed to be placed in both a first use position whereby the rack is adapted to be connected to a wall and a second stored position;

wherein the casing includes a first and a second casing right connector and a first and second casing left connector;

wherein the drawer is designed to slide inside and outside the casing and to be contained inside the casing when in either the first use position or the second stored position;

wherein the first right arm includes a first right arm connector that matches the first casing right connector that is designed to attach the first right arm to the casing in a way that the first right arm faces outward and to the right side;

wherein the first left arm includes a first left arm connector that matches the first casing left connector that is designed to attach the first left arm to the casing in a way that the first left arm faces outward and to the left side;

wherein the first right and left arms are designed to receive a first sport board when placed on the first right and left arms that are attached to the casing and the rack is in the first use position;

wherein the second right arm includes a second right arm connector that matches the second casing right connector that is designed to attach the second right arm to the casing in a way that the second right arm faces outward and to the right side;

wherein the second left arm includes a second left arm connector that matches the second casing left connector that is designed to attach the second left arm to the casing in a way that the second left arm faces outward and to the left side;

wherein the second right and left arms are designed to receive the second sport board when placed on the second right and left arms that are attached to the casing and the rack is in the first use position, wherein an inner length of the drawer is equal to or greater than a length of the first right and left arms and of the second right and left arms, and an inner width of the drawer is equal to or greater than a width of the first right and left arms and the second right and left arms, and wherein the drawer is designed to contain the first and second right arms and the first and second left arms when the rack is placed in the second stored position.

5. The rack of claim 4 wherein said casing connectors are casing slots and wherein said arm connectors are stopping tabs, and wherein the stopping tabs are designed to be inserted into the casing slots such that said arms are attached to the casing.

6. The rack of claim 4 wherein said casing further includes one or more casing rails and wherein said drawer includes one or more drawer rails that match the casing rails so that the drawer is designed to slide inside the casing along said rails.

7. A rack for hanging at least a first sport board, a second sport board, and a third sport board, whereby the rack comprises a casing, a drawer, a first right arm, a first left arm, a second right arm, a second left arm, a third right arm, and a third left arm, wherein the rack is designed to be placed in both a first use position whereby the rack is adapted to be connected to a wall and a second stored position;

wherein the casing includes a first, a second and a third casing right connector and a first, a second and a third casing left connector;

wherein the drawer is designed to slide inside and outside the casing and to be contained inside the casing when in either the first use position of the second stored position;

wherein the first right arm includes a first right arm connector that matches the first casing right connector that is designed to attach the first right arm to the casing in a way that the first right arm faces outward and to the right side;

wherein the first left arm includes a first left arm connector that matches the first casing left connector that is designed to attach the first left arm to the casing in a way that the first left arm faces outward and to the left side;

wherein the first right and left arms are designed to receive a first sport board when placed on the first right and left arms that are attached to the casing and the rack is in the first use position;

wherein the second right arm includes a second right arm connector that matches the second casing right connector that is designed to attach the second right arm to the casing in a way that the second right arm faces outward and to the right side;

wherein the second left arm includes a second left arm connector that matches the second casing left connector that is designed to attach the second left arm to the casing in a way that the second left arm faces outward and to the left side;

wherein the second right and left arms are designed to receive the second sport board when placed on the second right and left arms that are attached to the casing and the rack is in the first use position;

wherein the third right arm includes a third right arm connector that matches the third casing right connector that is designed to attach the third right arm to the casing in a way that the third right arm faces outward and to the right side;

wherein the third left arm includes a third left arm connector that matches the third casing left connector that is designed to attach the third left arm to the casing in a way that the third left arm faces outward and to the left side;

wherein the third right and left arms are designed to receive the third sport board when placed on the third right and left arms that are attached to the casing and the rack is in the first use position;

wherein an inner length of the drawer is equal to or greater than a length of the first right and left arms, of the second right and left arms, and of the third right and left arms, and an inner width of the drawer is equal to or greater than a width of the first right and left arms, of the second right and left arms, and of the third right and left arms and wherein the drawer is designed to contain the first, second and third right arms and the first, second and third left arms when the rack is placed in the second stored position.

8. The rack of claim 7 wherein said casing connectors are casing slots and wherein said arm connectors are stopping tabs, and wherein the stopping tabs are designed to be inserted into the casing slots such that said arms are attached to the casing.

9. The rack of claim 7 wherein said casing further includes one or more casing rails and wherein said drawer includes one or more drawer rails that match the casing rails so that the drawer is designed to slide inside the casing along said rails.

* * * * *